US012736037B2

(12) United States Patent
Nishida et al.

(10) Patent No.: US 12,736,037 B2
(45) Date of Patent: Sep. 15, 2026

(54) ROTARY SWASH PLATE HYDRAULIC PUMP

(71) Applicant: KAWASAKI JUKOGYO KABUSHIKI KAISHA, Kobe (JP)

(72) Inventors: Shinji Nishida, Kobe (JP); Isamu Yoshimura, Kobe (JP); Hideki Tamashima, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 54 days.

(21) Appl. No.: 18/852,350

(22) PCT Filed: Feb. 3, 2023

(86) PCT No.: PCT/JP2023/003559
§ 371 (c)(1),
(2) Date: May 9, 2025

(87) PCT Pub. No.: WO2023/188816
PCT Pub. Date: Oct. 5, 2023

(65) Prior Publication Data

US 2026/0002525 A1 Jan. 1, 2026

(30) Foreign Application Priority Data

Mar. 31, 2022 (JP) ..... 2022-061099

(51) Int. Cl.
*F04B 1/146* (2020.01)
*F04B 1/124* (2020.01)
(Continued)

(52) U.S. Cl.
CPC ..... *F04B 1/146* (2013.01); *F04B 1/14* (2013.01); *F04B 1/143* (2013.01); *F04B 1/145* (2013.01);
(Continued)

(58) Field of Classification Search
CPC .... F04B 1/28; F04B 1/146; F04B 1/22; F04B 1/145; F04B 49/08; F04B 1/143;
(Continued)

(56) References Cited

U.S. PATENT DOCUMENTS 2,923,251 A * 2/1960 De Laney ..... F03C 1/0613 91/476
3,496,873 A * 2/1970 Winter ..... F04B 49/12 417/270
2019/0353150 A1 11/2019 Akami

FOREIGN PATENT DOCUMENTS

CA 2303035 A1 3/1999
JP H07167111 A 7/1995
(Continued)

*Primary Examiner* — Peter J Bertheaud
(74) *Attorney, Agent, or Firm* — Alleman Hall LLP

(57) ABSTRACT

This rotary swash plate hydraulic pump includes: a casing; a cylinder block disposed in the casing so as to prevent relative rotation of the cylinder block and including a plurality of cylinder bores that are open on one end surface of the cylinder block; a rotary swash plate rotatably housed in the casing so as to face the one end surface of the cylinder block; a plurality of pistons each of which is inserted into a corresponding one of the plurality of cylinder bores and reciprocates within the corresponding one of the plurality of cylinder bores by rotation of the rotary swash plate; and a variable capacity mechanism that changes an effective stroke length of at least one piston included in the plurality of pistons.

8 Claims, 4 Drawing Sheets

(51) Int. Cl.

| | |
|---|---|
| ***F04B 1/14*** | (2020.01) |
| ***F04B 1/143*** | (2020.01) |
| ***F04B 1/145*** | (2020.01) |
| ***F04B 1/18*** | (2020.01) |
| ***F04B 1/182*** | (2020.01) |
| ***F04B 1/22*** | (2006.01) |
| ***F04B 1/28*** | (2006.01) |
| ***F04B 1/295*** | (2020.01) |
| ***F04B 1/32*** | (2020.01) |
| ***F04B 1/324*** | (2020.01) |
| ***F04B 49/08*** | (2006.01) |
| ***F04B 49/12*** | (2006.01) |
| ***F04B 49/16*** | (2006.01) |
| ***F04B 53/10*** | (2006.01) |
| ***F04B 53/16*** | (2006.01) |

(52) U.S. Cl.
CPC ..... *F04B 1/18* (2013.01); *F04B 1/182* (2013.01); *F04B 1/22* (2013.01); *F04B 1/28* (2013.01); *F04B 1/295* (2013.01); *F04B 1/32* (2013.01); *F04B 1/324* (2013.01); *F04B 49/08* (2013.01); *F04B 49/12* (2013.01); *F04B 49/16* (2013.01); *F04B 53/10* (2013.01); *F04B 53/16* (2013.01); *F04B 1/124* (2013.01)

(58) Field of Classification Search
CPC .. F04B 49/12; F04B 1/324; F04B 1/18; F04B 1/295; F04B 1/14; F04B 49/16; F04B 1/16; F04B 1/182; F04B 53/10; F04B 53/16
See application file for complete search history.

(56) References Cited

FOREIGN PATENT DOCUMENTS

| | | | |
|---|---|---|---|
| JP | 2016205266 | A | 12/2016 |
| JP | 2017015068 | A | 1/2017 |
| JP | 2018155199 | A | 10/2018 |

* cited by examiner

ROTARY SWASH PLATE HYDRAULIC PUMP

TECHNICAL FIELD

The present invention relates to a rotary swash plate hydraulic pump in which a rotary swash plate is rotated to reciprocate a piston.

BACKGROUND ART

For example, a rotary swash plate piston pump such as that disclosed in Patent Literature (PTL) 1 is known as a piston pump. In the piston pump disclosed in PTL 1, a piston reciprocates when a rotary swash plate rotates. As a result, pressure oil is discharged from the piston pump.

CITATION LIST

Patent Literature

PTL 1: Japanese Laid-Open Patent Application Publication No. 2016-205266

SUMMARY OF INVENTION

Technical Problem

The piston pump disclosed in PTL 1 has a fixed discharge capacity. However, it is desired that piston pumps have a discharge capacity that can be changed according to circumstances.

Thus, an object of the present invention is to provide a rotary swash plate hydraulic pump with a variable discharge capacity.

Solution to Problem

A rotary swash plate hydraulic pump according to the present invention includes: a casing; a cylinder block disposed in the casing so as to prevent relative rotation of the cylinder block and including a plurality of cylinder bores that are open on one end surface of the cylinder block; a rotary swash plate rotatably housed in the casing so as to face the one end surface of the cylinder block; a plurality of pistons each of which is inserted into a corresponding one of the plurality of cylinder bores and reciprocates within the corresponding one of the plurality of cylinder bores by rotation of the rotary swash plate; and a variable capacity mechanism that changes an effective stroke length of at least one piston included in the plurality of pistons.

According to the present invention, the variable capacity mechanism adjusts the effective stroke length of at least one piston. Therefore, the capacity of at least one cylinder bore can be changed. Thus, the discharge capacity of the rotary swash plate hydraulic pump can be changed.

Advantageous Effects of Invention

According to the present invention, the discharge capacity of the rotary swash plate hydraulic pump can be changed.

The above object, other objects, features, and advantages of the present invention will be made clear by the following detailed explanation of preferred embodiments with reference to the attached drawings.

DESCRIPTION OF EMBODIMENTS

Hereinafter, a rotary swash plate hydraulic pump 1 according to an embodiment of the present invention will be described with reference to the aforementioned drawings. Note that the concept of directions mentioned in the following description is used for the sake of explanation; the orientations, etc., of elements according to the invention are not limited to these directions. The hydraulic pump 1 described below is merely one embodiment of the present invention. Thus, the present invention is not limited to the embodiments and may be subject to addition, deletion, and alteration within the scope of the essence of the invention.

<Rotary Swash Plate Hydraulic Pump>

Figure 1:
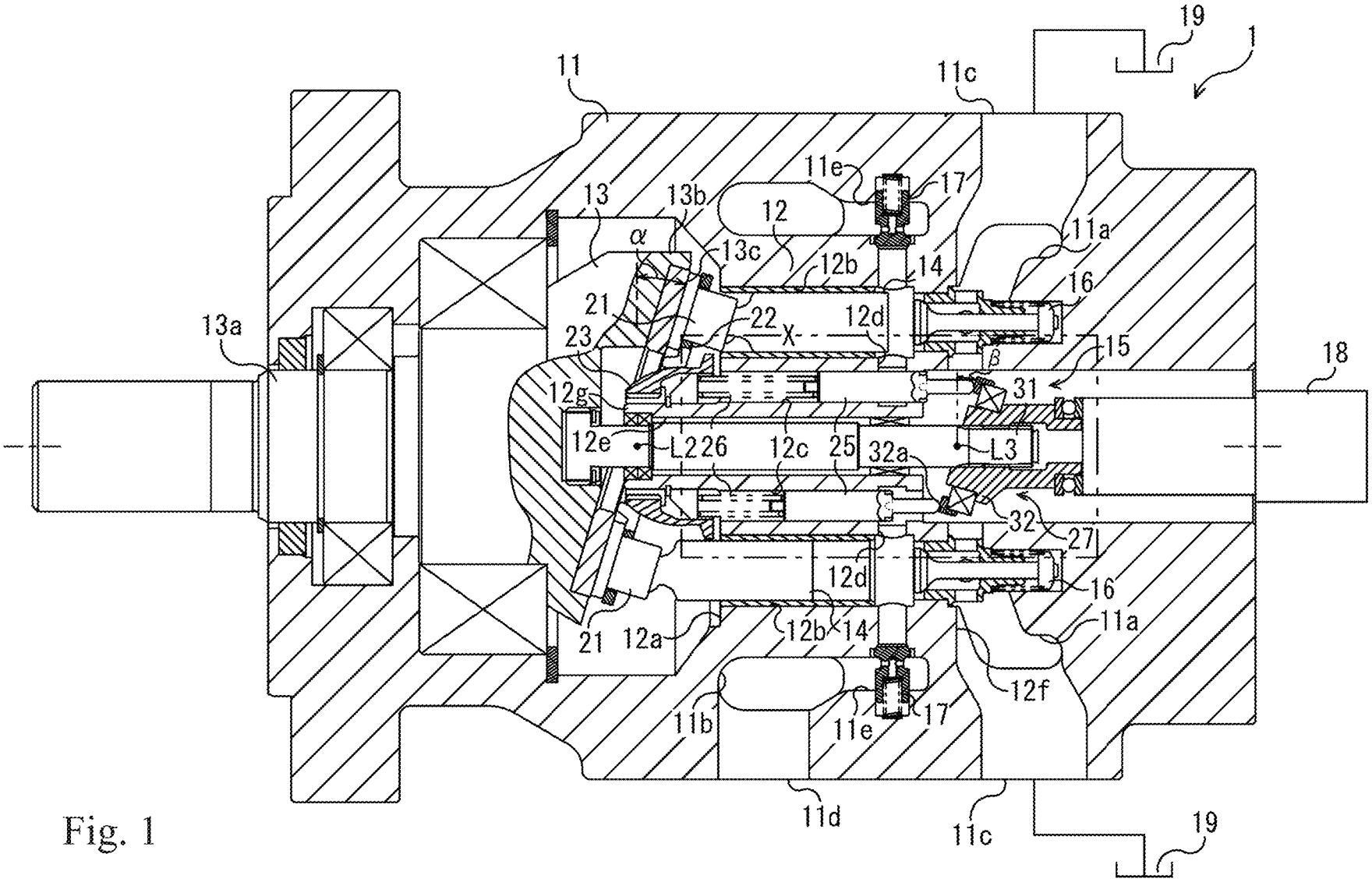
FIG. 1 is a cross-sectional view of a rotary swash plate hydraulic pump according to an embodiment of the present invention.

The rotary swash plate hydraulic pump 1 illustrated in FIG. 1 (hereinafter referred to as "the hydraulic pump 1") is provided in various machines, for example, construction equipment such as an excavator and a crane, industrial equipment such as a forklift, farm equipment such as a tractor, and hydraulic equipment such as a press machine. In the present embodiment, the hydraulic pump 1 is a pump of the rotary swash plate type with a variable capacity. The hydraulic pump 1 includes a casing 11, a cylinder block 12, a rotary swash plate 13, a plurality of pistons 14, and a variable capacity mechanism 15. More specifically, the hydraulic pump 1 includes a plurality of inlet-end check valves 16 and a plurality of discharge-end check valves 17. The hydraulic pump 1 is driven by a drive source (for example, one or both of an engine and an electric motor) to discharge a working fluid.

<Casing>

The casing 11 houses the cylinder block 12, the rotary swash plate 13, the plurality of pistons 14, and the variable capacity mechanism 15. The casing 11 includes an inlet passage 11*a* and a discharge passage 11*b*. The casing 11, which is a cylindrical member, extends along a predetermined axis L1. In other words, the casing 11 is open at one end and the other end that are located on one side and the other side, respectively, in the axial direction.

The inlet passage 11*a* is formed in the other end portion of the casing 11. The inlet passage 11*a* is connected to a plurality of cylinder bores 12*b* of the cylinder block 12, which will be described in detail later. Furthermore, the inlet passage 11*a* is connected to a tank 19 via an inlet port 11*c*. A discharge passage 11*b* is formed in a middle portion of the casing 11. The discharge passage 11*b* is connected to each of the cylinder bores 12*b* of the cylinder block 12, which will be described in detail later. More specifically, the discharge passage 11*b* branches into a plurality of passage portions 11*e* which are connected to side surfaces of the respective cylinder bores 12*b*. Furthermore, a passage portion 11*e* is connected to a hydraulic actuator via a discharge port 11*d*.

<Cylinder Block>

The cylinder block 12 is disposed inside the casing 11 so as to prevent relative rotation thereof. More specifically, the cylinder block 12 is fixed to the casing 11. In the present embodiment, the cylinder block 12 is integrally formed on an axially middle portion of the casing 11. Furthermore, the plurality of cylinder bores 12*b* which are open on one end surface 12*a* are formed in the cylinder block 12. Note that the one end surface 12*a* is an end surface of the cylinder block 12 that is located on one side in the axial direction. Furthermore, a plurality of spool holes 12*c*, a plurality of communication passages 12*d*, and a shaft insertion hole 12*e* are formed in the cylinder block 12. In the cylinder block 12, the number of cylinder bores 12*b* formed and the number of spool holes 12*c* formed are the same. In the present embodiment, nine cylinder bores 12*b* and nine spool holes 12*c* are formed in the cylinder block 12.

The nine cylinder bores 12*b* are arranged circumferentially spaced apart about the axis L1. Each of the cylinder bores 12*b* extends from the one end surface 12*a* to the other end in the axial direction. Each of the cylinder bores 12*b* is open on the one end surface 12*a* and the other end surface 12*f* of the cylinder block 12. Furthermore, each of the cylinder bores 12*b* is connected to the inlet passage 11*a* on the other end surface 12*f* of the cylinder block 12. Moreover, each of the cylinder bores 12*b* is connected to a corresponding one of the passage portions 11*e* of the discharge passage 11*b*.

The nine spool holes 12*c* are arranged circumferentially spaced apart about the axis L1. The nine spool holes 12*c* are positioned radially inward of the nine cylinder bores 12*b*. More specifically, the cylinder block 12 includes, on the one end surface 12*a*, a projection 12*g* extending about the axis L1. The projection 12*g* protrudes from the rest of the one end surface 12*a* in one axial direction. The nine spool holes 12*c* are arranged spaced apart from each other about the projection 12*g*. Each of the spool holes 12*c* is associated with a corresponding one of the cylinder bores 12*b*. Furthermore, each of the spool holes 12*c* is positioned radially inward of the corresponding cylinder bore 12*b*. The nine spool holes 12*c* also penetrate the cylinder block 12 in the axial direction. Furthermore, the nine spool holes 12*c* are connected to the inlet passage 11*a* on the other end surface 12*f* of the cylinder block 12.

Each of the communication passages 12*d* connects one of the cylinder bores 12*b* and a corresponding one of the spool holes 12*c*. Each of the communication passages 12*d* is located on the side of the other end surface 12*f* of the cylinder block 12. Furthermore, each of the communication passages 12*d* is open on the peripheral surface of one of the cylinder bores 12*b* and the peripheral surface of a corresponding one of the spool holes 12*c*. In the present embodiment, the communication passages 12*d* are positioned radially opposite the passage portions 11*e* of the discharge passage 11*b*. Therefore, the communication passages 12*d* can be easily formed.

The shaft insertion hole 12*e* is formed along the axis L1 in the cylinder block 12. The shaft insertion hole 12*e* penetrates the cylinder block 12 in the axial direction. More specifically, the shaft insertion hole 12*e* penetrates the cylinder block 12 from the leading end surface of the projection 12*g* to the other end surface 12*f* in the axial direction.

<Rotary Swash Plate>

The rotary swash plate 13 includes a shaft portion 13*a* and a swash plate portion 13*b*. The rotary swash plate 13 is rotatably housed in the casing 11 so as to face the one end surface 12*a* of the cylinder block 12. The shaft portion 13*a*, which extends along the axis L1, rotates about the axis L1. The shaft portion 13*a* protrudes from an end surface of the casing 11 that is located on one side in the axial direction, that is, one end of the casing 11. More specifically, a portion of the shaft portion 13*a* that is located on one side in the axial direction protrudes from one axial end of the casing 11. The portion of the shaft portion 13*a* that is located on one side in the axial direction is coupled to the drive source mentioned above. The shaft portion 13*a* is rotatably driven by the drive source.

The swash plate portion 13*b* includes a rotary swash plate-end inclined surface 13*c*. The swash plate portion 13*b* is disposed so that the rotary swash plate-end inclined surface 13*c* faces the one end surface 12*a* of the cylinder block 12. In the present embodiment, the rotary swash plate-end inclined surface 13*c* is in the form of a circular ring. The rotary swash plate-end inclined surface 13*c* faces the openings of the nine cylinder bores 12*b* that are located on one side in the axial direction. The rotary swash plate-end inclined surface 13*c* is tilted about a first perpendicular axis L2. The first perpendicular axis L2 is an axis perpendicular to the axis L1 which also serves as a rotation axis of the rotary swash plate 13. The rotary swash plate-end inclined surface 13*c* is tilted at a tilt angle $\alpha$. More specifically, the rotary swash plate-end inclined surface 13*c* is tilted at the tilt angle $\alpha$ about the first perpendicular axis L2 with respect to a perpendicular plane that is perpendicular to the axis L1.

<Piston>

The plurality of pistons 14 are inserted into the corresponding cylinder bores 12*b* of the cylinder block 12. In other words, the same number of pistons 14 as the cylinder bores 12*b* (in the present embodiment, nine pistons 14) are inserted into the cylinder block 12. When the rotary swash plate 13 rotates, each of the pistons 14 reciprocates within the corresponding cylinder bore 12*b*. More specifically, the nine pistons 14 are in abutment with the rotary swash plate-end inclined surface 13*c* of the rotary swash plate 13. Therefore, when the rotary swash plate-end inclined surface 13*c* of the rotary swash plate 13 rotates about the axis L1, each of the nine pistons 14 reciprocates with the corresponding cylinder bore 12*b* following the rotation of the rotary swash plate 13. In the present embodiment, a shoe 21 is slidably and rotatably attached to a leading end portion of each of the pistons 14 The pistons 14 are in abutment with the rotary swash plate-end inclined surface 13*c* of the rotary swash plate 13 via the shoes 21. Each of the shoes 21 is pressed against the rotary swash plate-end inclined surface 13*c* by a pressing plate 22. More specifically, a leading end portion of the projection 12*g* of the cylinder block 12 is covered by a spherical bushing 23. The spherical bushing 23, which is a cylindrical member, is partially spherical on one side in the axial direction. The pressing plate 22 is slidably attached to a portion of the spherical bushing 23 that is located on one side in the axial direction. Each of the shoes 21 is pressed against the rotary swash plate-end inclined surface 13*c* by the spherical bushing 23 via the pressing plate 22. Thus, when the rotary swash plate 13 rotates, the pistons 14 reciprocate back and forth in the axial direction via the shoes 21.

The piston 14 is configured not to block, at the top dead center, the passage portion 11*e* of the discharge passage 11*b* that is located on the side surface of the cylinder bore 12*b*. In other words, the piston 14 is configured to, while reciprocating, not block the passage portion 11*e* of the discharge passage 11*b*. For example, the other axial end of the piston 14 at the top dead center is never positioned beyond the passage portion 11*e* on the other side in the axial direction. Furthermore, in the present embodiment, the piston 14 is configured to, when located at the top dead center, not block the communication passage 12*d* that is located on the side surface of the cylinder bore 12*b*. In other words, the piston 14 is configured to, while reciprocating, not block the communication passage 12*d*.

<Variable Capacity Mechanism>

The variable capacity mechanism 15 includes a plurality of spools 25, a plurality of springs 26, and a swash plate rotating shaft 27. In the present embodiment, the variable capacity mechanism 15 includes the same number of spools 25 and springs 26 as the spool holes 12*c*, specifically, nine spools 25 and nine springs 26. The variable capacity mechanism 15 adjusts an effective stroke length S of each of the nine pistons 14. Thus, the variable capacity mechanism 15 can change the discharge capacity of the hydraulic pump 1. More specifically, the variable capacity mechanism 15 places the cylinder bore 12*b* in communication with the tank 19 via the spool hole 12*c* and the inlet passage 11*a* during the travel of the piston 14 at least from the bottom dead center to the top dead center (in other words, in the discharge process). Thus, the variable capacity mechanism 15 adjusts the effective stroke length S of each of the pistons 14. The variable capacity mechanism 15 is positioned radially inward of the nine cylinder bores 12*b*.

<Spool>

The nine spools 25 are arranged corresponding to the cylinder bores 12*b*, respectively. The nine spools 25 reciprocate to open and close the paths between the corresponding cylinder bores 12*b* and the tank 19 (refer to FIG. 1). In the present embodiment, the nine spools 25 reciprocate to open and close the paths between the corresponding cylinder bores 12*b* and the inlet passage 11*a*. Furthermore, the nine spools 25 connect the corresponding cylinder bores 12*b* to the tank 19 via the inlet passage 11*a*. The spool 25 reciprocates in synchronization with the reciprocation of the piston 14 located in the corresponding cylinder bore 12*b* (hereinafter referred to as "the corresponding piston 14"). The spools 25 will be described in more detail below.

Each of the spools 25 is a columnar member. Each of the nine spools 25 is inserted through a corresponding one of the spool holes 12*c* in such a manner that the spool 25 can reciprocate therein. A round portion 25*a*, which is a middle portion of each of the spools 25, has an outer diameter equal to the hole diameter of the spool hole 12*c*. The spool 25 includes a small-diameter portion 25*b* on the other side in the axial direction. The small-diameter portion 25*b*, which extends to the other end surface of the spool 25 that is located on the other side in the axial direction, is formed having a diameter less than the diameter of the round portion 25*a*. Therefore, the communication passage 12*d* is closed by the spool 25 while the round portion 25*a* faces the communication passage 12*d* and the small-diameter portion 25*b* does not face the communication passage 12*d*. Thus, each of the spools 25 can close the path between the corresponding cylinder bore 12*b* and the inlet passage 11*a*. Furthermore, the spool 25 opens the communication passage 12*d* while the small-diameter portion 25*b* faces the communication passage 12*d*. Thus, each of the spools 25 can open the path between the corresponding cylinder bore 12*b* and the inlet passage 11*a*.

Each of the spools 25 configured as described above reciprocates to open and close the path between the corresponding cylinder bore 12*b* and the inlet passage 11*a*. For example, when each of the spools 25 moves toward the bottom dead center of the corresponding piston 14, the spool 25 eventually opens the path between the corresponding cylinder bore 12*b* and the inlet passage 11*a*. On the other hand, when each of the spools 25 moves toward the top dead center of the corresponding piston 14, the spool 25 eventually closes the path between the corresponding cylinder bore 12*b* and the inlet passage 11*a*. Therefore, the spool 25 can connect the cylinder bore 12*b* to the tank 19 in the discharge process.

Each of the spools 25 includes a plurality of notches 25*c* on the round portion 25*a*. The plurality of notches 25*c* are formed on a portion of the outer peripheral surface of the round portion 25*a* of the spool 25 that is located at the other axial end. In the present embodiment, four notches 25*c* are formed on the outer peripheral surface of the middle portion of the spool 25. Note that the number of notches 25*c* is not limited to four. The notches 25*c* are formed circumferentially spaced apart from each other. The notches 25*c* reduce a sharp increase in pressure at the cylinder bores 12*b* when the communication passages 12*d* are closed.

<Spring>

Each of the nine springs 26 is housed in a corresponding one of the spool holes 12*c*. Each of the springs 26 is disposed in the state of being compressed by the corresponding spool 25 on one side in the axial direction in the corresponding spool hole 12*c*. The spring 26 is in abutment with one end of the spool 25. The spring 26 biases the spool 25 toward a swash plate portion 32 to be described later.

<Swash Plate Rotating Shaft>

The swash plate rotating shaft 27 rotates in conjunction with the rotary swash plate 13. The swash plate rotating shaft 27 rotates to reciprocate each of the spools 25. By reciprocating each of the spools 25, the swash plate rotating shaft 27 opens and closes the path between the corresponding cylinder bore 12*b* and the tank 19. More specifically, the swash plate rotating shaft 27 opens and closes the communication passages 12*d* by reciprocating the spools 25. Furthermore, the swash plate rotating shaft 27 can change the opening/closing position of each of the spools 25. The opening/closing position of each of the spools 25 is a position at which the spool 25 starts opening the communication passage 12*d* and a position at which the spool 25 starts closing the communication passage 12*d*. The swash plate rotating shaft 27 will be described in more detail below.

The swash plate rotating shaft 27 includes a shaft portion 31 and a swash plate portion 32. The shaft portion 31 extends in the axial direction. More specifically, the shaft portion 31 is inserted through the shaft insertion hole 12*e* of the cylinder block 12 and extends along the axis L1. The shaft portion 31 is pivotally supported in the shaft insertion hole 12*e*. One axial end portion of the shaft portion 31 protrudes from the shaft insertion hole 12*e* toward the rotary swash plate 13. The one axial end portion of the shaft portion 31 is coupled to the rotary swash plate 13 so as to prevent relative rotation thereof. Therefore, the shaft portion 31 rotates about the axis L1 in conjunction with the rotary swash plate 13. The other axial end portion of the shaft portion 31 also protrudes from the shaft insertion hole 12*e* toward the inlet passage 11*a*.

The swash plate portion 32 includes a swash plate rotating shaft-end inclined surface 32*a*. By the rotation of the swash plate rotating shaft 27, the swash plate portion 32 reciprocates each of the spools 25. The swash plate portion 32 causes the spool 25 to reciprocate in synchronization with the reciprocation of the corresponding piston 14. The swash plate portion 32 is provided on the exterior of the shaft portion 31 so as to prevent relative rotation thereof and allow axial movement thereof. More specifically, the swash plate portion 32 is disposed in the inlet passage 11*a*. The swash plate portion 32 is provided on the exterior of the other axial end portion of the shaft portion 31 so as to prevent relative rotation thereof and allow axial movement thereof. The swash plate portion 32 faces the other end surface 12*f* of the cylinder bore 12*b*.

The swash plate rotating shaft-end inclined surface 32*a* is placed on one side in the axial direction in the swash plate portion 32. The swash plate rotating shaft-end inclined surface 32*a* is disposed facing the other end of the cylinder block 12. In the present embodiment, the swash plate rotating shaft-end inclined surface 32*a* is in the form of a circular ring. The swash plate rotating shaft-end inclined surface 32*a* faces the openings of the nine spool holes 12*c* that are located on the other side in the axial direction. The other axial ends of the nine spools 25 that are biased by the springs 26 are in abutment with the swash plate rotating shaft-end inclined surface 32*a*. Therefore, when the swash plate rotating shaft 27 rotates, the plurality of spools 25 reciprocate within the spool holes 12*c*.

Furthermore, in the swash plate portion 32, the swash plate rotating shaft-end inclined surface 32*a* is tilted about a second perpendicular axis L3 parallel to the first perpendicular axis L2. In the present embodiment, the second perpendicular axis L3 is also an axis perpendicular to the axis L1. The swash plate rotating shaft-end inclined surface 32*a* is tilted at a tilt angle β. More specifically, the swash plate rotating shaft-end inclined surface 32*a* is tilted at the tilt angle β about the second perpendicular axis L3 with respect to a perpendicular plane that is perpendicular to the axis L1. In the present embodiment, the swash plate rotating shaft-end inclined surface 32*a* is tilted in the same direction as the rotary swash plate-end inclined surface 13*c*.

In the swash plate portion 32, the swash plate rotating shaft-end inclined surface 32*a* is tilted in the same direction as the rotary swash plate-end inclined surface 13*c*. Therefore, the swash plate portion 32 rotates in conjunction with the rotary swash plate 13 to cause the spool 25 to reciprocate in synchronization with the corresponding piston 14. More specifically, the swash plate rotating shaft 27 synchronizes the timings at which the spool 25 and the corresponding piston 14 are positioned at the dead centers. Thus, the swash plate rotating shaft 27 can place the cylinder bore 12*b* in communication with the inlet passage 11*a* when the corresponding piston 14 is located at the bottom dead center. On the other hand, the swash plate rotating shaft 27 can restrict the opening degree between the cylinder bore 12*b* and the inlet passage 11*a* and eventually close the path therebetween as the corresponding piston 14 travels from the bottom dead center toward the top dead center. The tilt angle β of the swash plate rotating shaft-end inclined surface 32*a* is greater than the tilt angle α of the rotary swash plate-end inclined surface 13*c*. Therefore, the spool 25 can be moved more rapidly than the piston 14, allowing the communication passage 12*d* to be quickly closed. Thus, it is possible to reduce pressure loss that occurs at the time of closing the communication passage 12*d*. In the present embodiment, the tilt angle β preferably satisfies the relationship $\alpha<\beta\leq\alpha+30$. Note that the tilt angle β may be less than or equal to the tilt angle α.

Furthermore, the swash plate portion 32 is capable of moving back and forth in the axial direction. By moving back and forth, the swash plate portion 32 adjusts the opening/closing position of the spool 25. More specifically, the swash plate portion 32 is provided on the exterior of the shaft portion 31 so as to allow relative movement thereof in the axial direction. Therefore, the swash plate portion 32 can move back and forth relative to the other end surface 12*f* of the cylinder block 12. Furthermore, a linear motion actuator 18 is connected to the swash plate portion 32. The linear motion actuator 18 moves the swash plate portion 32 back and forth in the axial direction. Thus, since the swash plate 32 moves back and forth relative to the other end surface 12*f* of the cylinder block 12, the dead center position (more specifically, the axial position of the dead center) of the spool 25 in the cylinder bore 12*b* can be changed. For example, when the swash plate portion 32 moves forward in the one axial direction, the dead center position of the spool 25 in the cylinder bore 12*b* shifts in the one axial direction. On the other hand, when the swash plate portion 32 moves backward in the other axial direction, the dead center position of the spool 25 in the cylinder bore 12*b* shifts in the other axial direction. Therefore, the opening/closing position of the spool 25 in the cylinder bore 12*b* can be shifted in the axial direction. The effective stroke length S of each of the pistons 14 is a range of stroke in which the working fluid can be discharged from the corresponding cylinder bore 12*b*. Specifically, the effective stroke length S is a value obtained by subtracting an open stroke length S2 from an actual stroke length S1. The actual stroke length S1 is the stroke length of actual travel (that is, the distance from the bottom dead center to the top dead center) of the piston 14. The open stroke length S2 is the stroke length of the piston 14 traveling from the bottom dead center until the communication passage 12*d* is closed; when the opening/closing position changes, the open stroke length S2 changes. Therefore, it is possible to adjust the effective stroke length S of each of the pistons 14 by moving the swash plate portion 32 back and forth. Thus, the discharge capacity of each of the cylinder bores 12*b* can be changed.

<Inlet-End Check Valve>

Each of the inlet-end check valves 16 is provided on a corresponding one of the cylinder bores 12*b*. This means that there are the same number of inlet-end check valves 16 as the cylinder bores 12*b*, specifically, nine inlet-end check valves 16, in the present embodiment. The inlet-end check valve 16 opens and closes the path between the cylinder bore 12*b* and the inlet passage 11*a*. More specifically, the inlet-end check valve 16 allows the flow of the working fluid from the inlet passage 11*a* to the cylinder bore 12*b* and blocks the opposite flow of the working fluid. Specifically, in the intake process in which the piston 14 moves from the top dead center to the bottom dead center, the working fluid flows from the inlet passage 11*a* to the cylinder bore 12*b*. On the other hand, in the discharge process, the flow of the working fluid from the inlet passage 11*a* to the cylinder bore 12*b* is stopped.

<Discharge-End Check Valve>

Each of the discharge-end check valves 17 is provided on a corresponding one of the cylinder bores 12*b*. In the present embodiment, each of the discharge-end check valves 17 is provided on a corresponding one of the passage portions 11*e* of the discharge passage 11*b*. This means that there are the same number of discharge-end check valves 17 as the passage portions 11*e*, in other words, as the cylinder bores 12*b*, specifically, nine discharge-end check valves 17, in the present embodiment. The discharge-end check valve 17 opens and closes the path between the cylinder bore 12*b* and the discharge port 11*d*. More specifically, the discharge-end check valve 17 allows the flow of the working fluid from the cylinder bore 12*b* to the discharge port 11*d* and blocks the opposite flow of the working fluid. When the hydraulic pressure of the cylinder bore 12*b* becomes greater than or equal to a predetermined set pressure, the discharge-end check valve 17 allows the flow of the working fluid from the cylinder bore 12*b* to the discharge port 11*d*. In other words, in the intake process, the flow of the working fluid from the cylinder bore 12*b* to the discharge port 11*d* is stopped. On the other hand, in the discharge process, the working fluid flows from the cylinder bore 12*b* to the discharge port 11*d*.

<Operation of Hydraulic Pump>

When the drive source rotatably drives the rotary swash plate 13, the hydraulic pump 1 operates as follows. Specifically, when the rotary swash plate 13 is rotatably driven, each of the pistons 14 reciprocates within the corresponding cylinder bore 12*b* accordingly. Thus, the piston 14 draws the working fluid from the inlet port 11*c* into the cylinder bore 12*b* via the inlet-end check valve 16 through the inlet passage 11*a* in the intake process. On the other hand, the piston 14 discharges the working fluid from the cylinder bore 12*b* to the discharge port 11*d* via the discharge-end check valve 17 in the discharge process.

Figure 2:
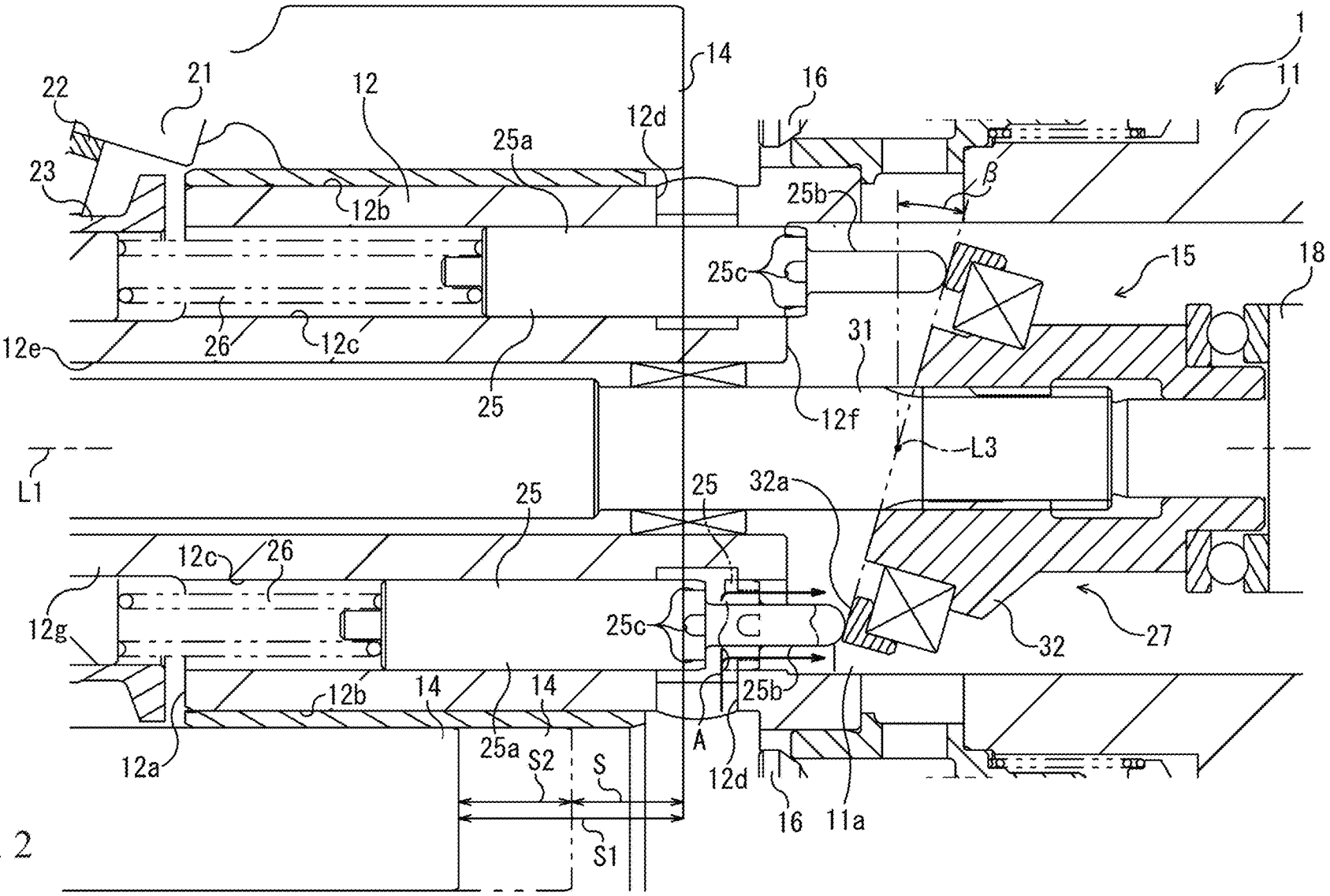
FIG. 2 is an enlarged cross-sectional view of a region X of the rotary swash plate hydraulic pump illustrated in FIG. 1.

Furthermore, in the hydraulic pump 1, the swash plate rotating shaft 27 rotates in conjunction with the rotation of the rotary swash plate 13. Thus, each of the spools 25 reciprocates within the corresponding spool hole 12*c* in synchronization with the corresponding piston 14. As a result, the communication passage 12*d* is opened midway through the intake process of the piston 14, and the communication passage 12*d* is closed midway through the discharge process of the piston 14 (refer to the piston 14 indicated by the dash-dot-dot-dash line in FIG. 2) (refer to the spool 25 indicated by the dash-dot-dot-dash line in FIG. 2). Thus, the cylinder bore 12*b* and the communication passage 12*d* are in communication until the communication passage 12*d* is closed (in other words, until the piston 14 travels the open stroke length S2) in the discharge process. As a result, the working fluid in the cylinder bore 12*b* is drained to the inlet passage 11*a* through the communication passage 12*d* (refer to the arrow A indicated in FIG. 2). This keeps the hydraulic pressure of the cylinder bore 12*b* less than the set pressure (for example, the tank pressure). Thus, the discharge of the working fluid from the cylinder bore 12*b* to the discharge port 11*d* is limited until the communication passage 12*d* is closed. Therefore, the effective stroke length S of each of the pistons 14 is less than the actual stroke length S1 by the open stroke length S2, and the hydraulic pump 1 discharges an amount of the working fluid that corresponds to the effective stroke length S. In the hydraulic pump 1, the effective stroke length S can be adjusted using the variable capacity mechanism 15. A method for adjusting the effective stroke length S in the hydraulic pump 1 will be described in detail below.

Figure 3:
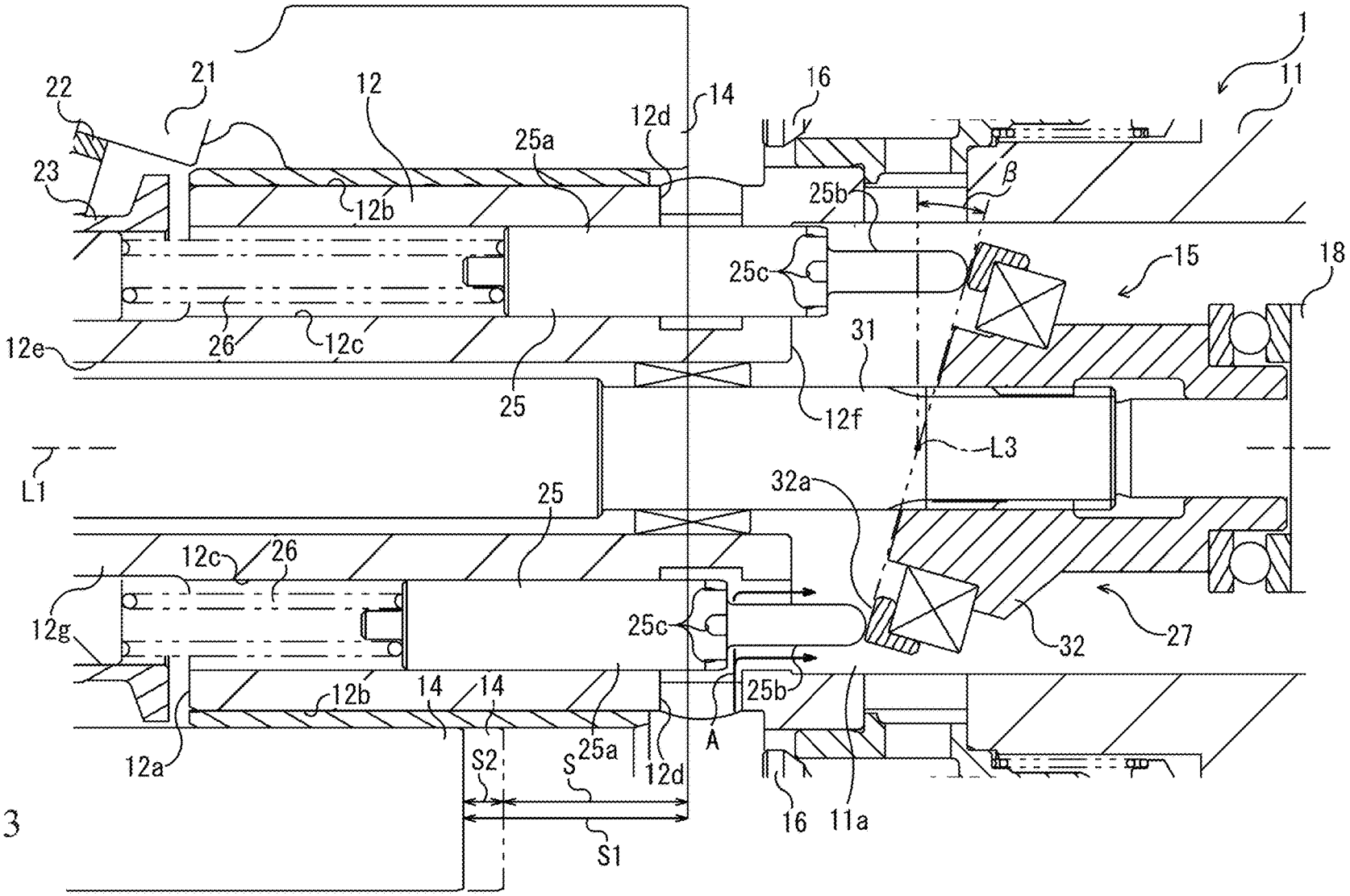
FIG. 3 is an enlarged cross-sectional view of a rotary swash plate hydraulic pump with a discharge capacity that has been changed.

In the hydraulic pump 1, the linear motion actuator 18 moves the swash plate portion 32 in the axial direction in order to change the effective stroke length S. The linear motion actuator 18 is driven by an electric motor, for example. Note that the linear motion actuator 18 is not limited to those driven by an electric motor and may be of the hydraulic type represented by a hydraulic cylinder. For example, when the linear motion actuator 18 moves the swash plate portion 32 backward in the other axial direction as illustrated in FIG. 3, the bottom dead center of each of the spools 25 shifts in the other axial direction. As a result, the opening/closing position of the spool 25 changes (refer to the spool 25 indicated by the dash-dot-dot-dash line in FIG. 3), and the open stroke length S2 of the piston 14 is reduced (refer to the piston 14 indicated by the dash-dot-dot-dash line in FIG. 3). Thus, the effective stroke length S of the piston 14 can be increased. Therefore, the discharge capacity of the hydraulic pump 1 increases. Note that when the swash plate portion 32 moves backward as far as possible, the open stroke length S2 of the piston 14 becomes zero. Therefore, the discharge capacity of the hydraulic pump 1 reaches the maximum.

Figure 4:
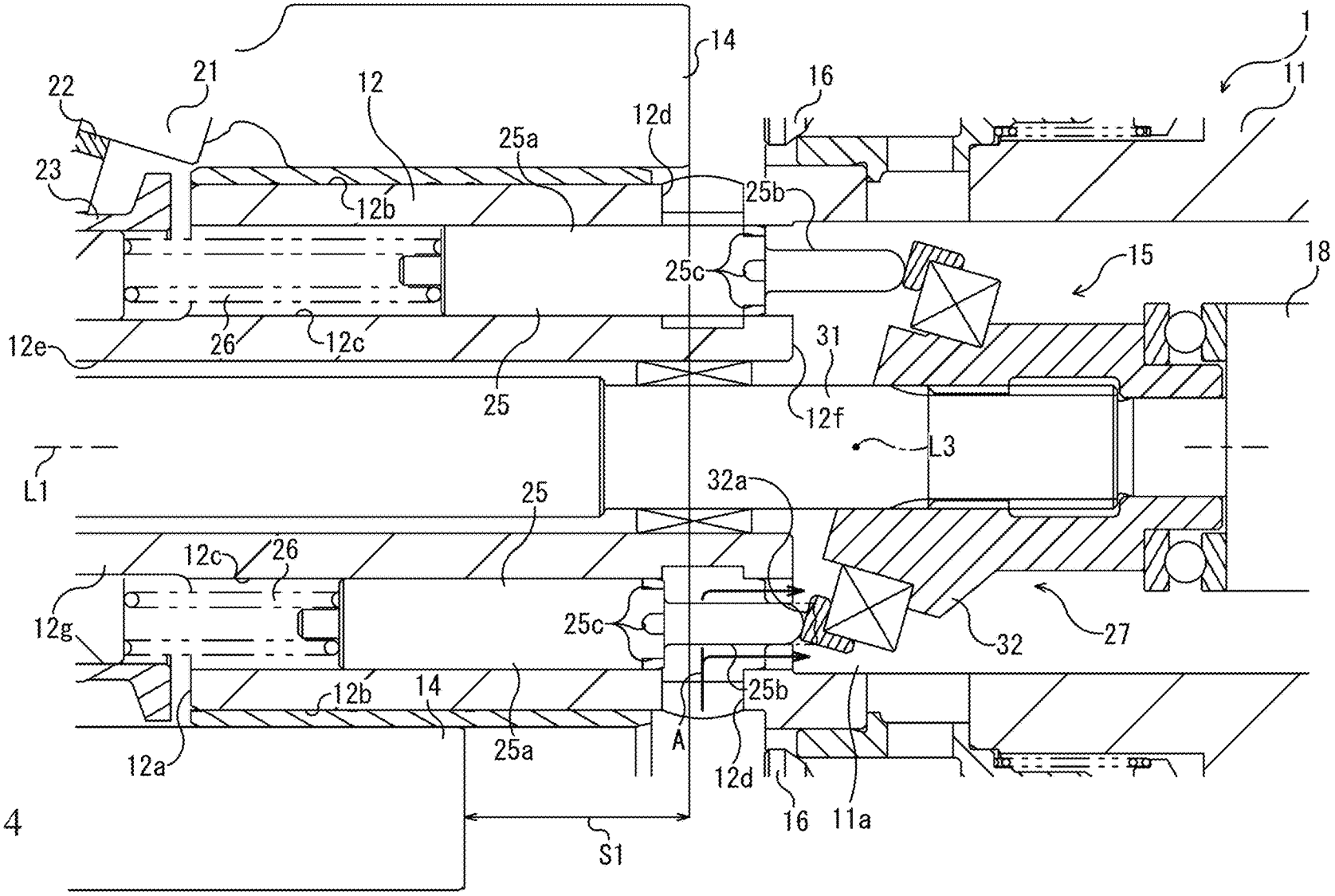
FIG. 4 is an enlarged cross-sectional view of a rotary swash plate hydraulic pump with a discharge capacity that has been changed to the minimum discharge capacity.

On the other hand, when the linear motion actuator 18 moves the swash plate portion 32 forward in the one axial direction, a position at which each of the spools 25 abuts the swash plate portion 32 shifts in the one axial direction. As a result, the opening/closing position of the spool 25 changes, and the open stroke length S2 of the piston 14 is reduced. Thus, the effective stroke length S of the piston 14 is reduced. Therefore, the discharge capacity of the hydraulic pump 1 decreases. For example, when the swash plate portion 32 moves forward as far as possible, as illustrated in FIG. 4, the effective stroke length S of the piston 14 becomes zero. Therefore, the discharge capacity of the hydraulic pump 1 reaches the minimum (that is zero in the present embodiment).

In the hydraulic pump 1 according to the present embodiment, the effective stroke length S of each of the pistons 14 is adjusted using the variable capacity mechanism 15. Therefore, it is possible to change the capacity, that is, the discharge capacity in the present embodiment, of each of the cylinder bores 12*b*. Thus, it is possible to change the capacity, that is, the discharge capacity in the present embodiment, of the hydraulic pump 1.

In the hydraulic pump 1 according to the present embodiment, as a result of the cylinder bore 12*b* being in communication with the tank 19 in the discharge process of the piston 14, the working fluid in the cylinder bore 12 is drained to the tank 19 while the cylinder bore 12*b* is in communication with the tank 19. In this case, the discharge of the working fluid from the cylinder bore 12*b* is stopped while the cylinder bore 12*b* is in communication with the tank 19. This results in a change in the effective stroke length S of the piston 14. Therefore, the discharge capacity of the hydraulic pump 1 can be changed.

In the hydraulic pump 1 according to the present embodiment, it is possible to change the effective stroke length S by changing the opening/closing position of the spool 25. Therefore, the discharge capacity of the hydraulic pump 1 can be easily changed.

In the hydraulic pump 1 according to the present embodiment, the spool 25 reciprocates in synchronization with the reciprocation of the piston 14. Therefore, the path between the cylinder bore 12*b* and the tank 19 can be opened and closed following the reciprocation of the piston 14. This results in a reduction in the occurrence of power loss that is due to a difference in timing between the movement of the piston 14 and the opening/closing of the spool 25.

In the hydraulic pump 1 according to the present embodiment, it is possible to change the opening/closing position of the spool 25 by moving the swash plate portion 32 back and forth. Therefore, the opening/closing position of the spool 25 can be easily adjusted.

In the hydraulic pump 1 according to the present embodiment, the perpendicular axes L2, L3 of the rotary swash plate-end inclined surface 13*c* and the swash plate rotating shaft-end inclined surface 32*a* are parallel to each other and tilted in the same direction. Therefore, it is possible to reciprocate the spool 25 in synchronization with the reciprocation of the piston 14. This results in a reduction in the occurrence of power loss that is due to a difference in timing between the movement of the piston 14 and the opening/closing of the spool 25.

In the hydraulic pump 1 according to the present embodiment, the swash plate rotating shaft-end inclined surface 32*a* has the tilt angle $\beta$ greater than the tilt angle $\alpha$ of the rotary swash plate-end inclined surface 13*c*. Therefore, it is possible to increase a shutter speed that is a speed at which the path between the cylinder bore 12*b* and the tank 19 is closed. Thus, it is possible to reduce pressure loss that occurs at the time of closing the communication passage 12*d* by the spool 25.

In the hydraulic pump 1 according to the present embodiment, the inlet-end check valve 16 allows the flow of the working fluid from the inlet port 11*c* to the cylinder bore 12*b* and blocks the opposite flow of the working fluid. Therefore, the working fluid is drawn from the inlet port 11*c* into the cylinder bore 12*b* in the intake process and furthermore, the working fluid is kept from being discharged from the cylinder bore 12*b* to the inlet port 11*c* in the discharge process.

In the hydraulic pump 1 according to the present embodiment, the discharge-end check valve 17 allows the flow of the working fluid from the cylinder bore 12*b* to the discharge port 11*d* and blocks the opposite flow of the working fluid. Therefore, the working fluid is kept from flowing from the cylinder bore 12*b* to the discharge port 11*d* in the intake process and furthermore, the working fluid is discharged from the cylinder bore 12*b* to the discharge port 11*d* in the discharge process.

In the hydraulic pump 1 according to the present embodiment, the variable capacity mechanism 15 is positioned radially inward of the plurality of cylinder bores 12*b* in the cylinder block 12. Thus, the hydraulic pump 1 can be made compact.

OTHER EMBODIMENTS

In the hydraulic pump 1 according to the present embodiment, the spool 25 in the variable capacity mechanism 15 may be configured as a valve body. When the spool 25 is a valve body, the valve body opens and closes the communication passage 12*d*, for example. Furthermore, the inlet-end check valve 16 may function as the variable capacity mechanism 15. For example, the inlet-end check valve 16 achieves substantially the same functions as the spool 25 by placing the cylinder bore 12*b* and the inlet passage 11*a* in communication for a while after the bottom dead center in the discharge process. Furthermore, the variable capacity mechanism 15 may be located radially outward of the cylinder bores 12*b*.

Furthermore, in the hydraulic pump 1 according to the present embodiment, all the spools 25 are formed into the same shape, but the spools 25 may have different shapes. For example, the round portions 25*a* of the spools 25 may have different lengths. Furthermore, three or six spools 25 out of the nine spools 25 may be totally-enclosed spools that do not open the communication passage 12*d*. Moreover, the number of spools 25 does not need to be equal to the number of pistons 14 and may be less than the number of pistons 14. In this case, it is preferable that the number of spool holes 12*c* be substantially the same as the number of spools 25. Furthermore, in the hydraulic pump 1 according to the present embodiment, the effective stroke length S of every piston 14 is adjusted, but it is sufficient that the effective stroke length S of at least one piston 14 be adjusted.

Furthermore, in the hydraulic pump 1 according to the present embodiment, the spool 25 does not need to include the notch 25*c*. Furthermore, the spring 26 is in direct abutment with one end of the spool 25 in the present embodiment, but may be in abutment with one end of the spool 25 via a member such as a ball.

Furthermore, in the hydraulic pump 1 according to the present embodiment, the communication passage 12*d* is connected to the tank 19 via the inlet passage 11*a*, but the communication passage 12*d* may be connected directly to the tank 19 or may be connected to the tank 19 via another passage or the like.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

The invention claimed is:

1. A rotary swash plate hydraulic pump comprising:

a casing;

a cylinder block disposed in the casing so as to prevent relative rotation of the cylinder block and including a plurality of cylinder bores that are open on one end surface of the cylinder block;

a rotary swash plate rotatably housed in the casing so as to face the one end surface of the cylinder block;

a plurality of pistons each of which is inserted into a corresponding one of the plurality of cylinder bores and reciprocates within the corresponding one of the plurality of cylinder bores by rotation of the rotary swash plate; and a variable capacity mechanism that changes an effective stroke length of at least one piston included in the plurality of pistons, wherein:

the variable capacity mechanism includes a plurality of spools arranged corresponding to the plurality of cylinder bores, respectively, and each of which reciprocates to open and close a path between a corresponding one of the plurality of cylinder bores and a tank, and changes the effective stroke length of the at least one piston by changing an opening/closing position of a corresponding one of the plurality of spools and placing at least a corresponding one of the plurality of cylinder bores and the tank in communication in a discharge process of the plurality of pistons.

2. The rotary swash plate hydraulic pump according to claim 1, wherein:

each of the plurality of spools reciprocates in synchronization with reciprocation of one of the plurality of pistons that is located in a corresponding one of the plurality of cylinder bores.

3. The rotary swash plate hydraulic pump according to claim 1, wherein:

the variable capacity mechanism further includes a swash plate rotating shaft that rotates in conjunction with the rotary swash plate;

the swash plate rotating shaft includes a swash plate portion that reciprocates each of the plurality of spools by rotation of the swash plate rotating shaft; and the swash plate portion is capable of moving back and forth in an axial direction and adjusts the opening/closing position of each of the plurality of spools by moving back and forth.

4. The rotary swash plate hydraulic pump according to claim 3, wherein:

the rotary swash plate includes a rotary swash plate-end inclined surface which the plurality of pistons abut;

the swash plate portion includes a swash plate rotating shaft-end inclined surface which the plurality of spools abut;

the rotary swash plate-end inclined surface is tilted about a first perpendicular axis perpendicular to a rotation axis of the rotary swash plate; and the swash plate rotating shaft-end inclined surface is tilted about a second perpendicular axis parallel to the first perpendicular axis and is tilted in the same direction as the rotary swash plate-end inclined surface.

5. The rotary swash plate hydraulic pump according to claim 4, wherein:

the swash plate rotating shaft-end inclined surface has a tilt angle $\beta$ greater than a tilt angle $\alpha$ of the rotary swash plate-end inclined surface.

6. The rotary swash plate hydraulic pump according to claim 1, further comprising:

a plurality of inlet-end check valves each disposed in a corresponding one of the plurality of cylinder bores, wherein:

the casing includes an inlet port in which a working fluid flows; and the plurality of inlet-end check valves allow a flow of the working fluid from the inlet port to the plurality of cylinder bores and block an opposite flow of the working fluid.

7. The rotary swash plate hydraulic pump according to claim 1, further comprising:

a plurality of discharge-end check valves arranged corresponding to the plurality of cylinder bores, respectively, wherein:

the casing includes a discharge port in which a working fluid flows; and the plurality of discharge-end check valves allow a flow of the working fluid from the plurality of cylinder bores to the discharge port and block an opposite flow of the working fluid.

8. The rotary swash plate hydraulic pump according to claim 1, wherein:

the plurality of cylinder bores are disposed spaced apart about a predetermined axis in the cylinder block; and the variable capacity mechanism is positioned radially inward of the plurality of cylinder bores in the cylinder block.

* * * * *